United States Patent [19]

Derleth

[11] 4,019,055

[45] Apr. 19, 1977

[54] CORONA CLEANING ASSEMBLY

[75] Inventor: James L. Derleth, Rochester, N.Y.

[73] Assignee: Xerox Corporation, Stamford, Conn.

[22] Filed: June 6, 1973

[21] Appl. No.: 367,607

Related U.S. Application Data

[63] Continuation of Ser. No. 245,306, April 19, 1972, abandoned.

[52] U.S. Cl. ..... 250/324

[51] Int. Cl.[2] ..... G03G 15/00

[58] Field of Search ..... 250/324, 325, 326; 317/262 A

[56] References Cited

UNITED STATES PATENTS 2,885,556 5/1959 Gundlach ..... 250/325

OTHER PUBLICATIONS

"Corona Unit Cleaning Device", W. Volt, IBM Technical Disclosure Bulletin, vol. 11, No. 8, Jan. 1969, p. 1025.

*Primary Examiner*—Craig E. Church
*Attorney, Agent, or Firm*—Earl T. Reichert

[57] ABSTRACT

A corona discharge device has a cleaning assembly for cleaning both its corona discharge electrode and a conductive shield partially surrounding the electrode. The cleaning assembly includes a wiper which is in contact with both the electrode and the shield, and movement of the wiper within the discharge device effects cleaning of both the electrode and the shield.

1 Claim, 5 Drawing Figures

CORONA CLEANING ASSEMBLY

This is a continuation of application Ser. No. 245,306, filed Apr. 19, 1972, now abandoned.

BACKGROUND OF THE INVENTION

This invention relates to electrostatography, and in particular, to an apparatus for cleaning a corona discharge device.

In the practice of xerography as described in U.S. Pat. No. 2,297,691 to Chester F. Carlson, a xerographic surface comprising a layer of photoconductive insulating material affixed to a conductive backing is used to support electrostatic images. In the usual method of carrying out the process, the xerographic plate is electrostatically charged uniformly over its surface and then exposed to a light pattern of the image being reproduced to thereby discharge the charge in the areas where light strikes the layer. The undischarged areas of the layer thus form an electrostatic charge pattern in conformity with the configuration of the original light pattern.

The latent electrostatic image may then be developed by contacting it with a finely divided electrostatically attractable material, such as a resinous powder. The powder is held in the image areas by the electrostatic fields on the layer. Where the field is greatest, the greatest amount of material is deposited, where the field is least, little or no material is deposited. Thus, a powder image is produced in conformity with the light image of the copy being reproduced. The powder is subsequently transferred to a sheet of paper or other surface and suitably affixed to thereby form a permanent print.

In the electrophotographic reproducing art, it is necessary to deposit a uniform layer of electrostatic charges on the surface of a photoreceptor such that the electrostatic charges may be selectively dissipated in accordance with modulated radiation imaged thereon to form an electrostatic latent image of an original document. The prior art has suggested various techniques and devices for applying a uniform electrostatic charge on the surface of a photoreceptor. One technique utilizes a corona discharge device of the type described in U.S. Pat. No. 2,777,957 which issued to L. E. Walkup. A particular type of corona discharge device that has been readily included in conventional electrophotographic reproducing apparatus is described in detail in U.S. Pat. No. 2,836,725 which issued to R. G. Vyverberg and assigned to Xerox Corporation. Such a device is usually comprised of a corona discharge electrode, such as a corona wire, surrounded by a conductive shield. The corona discharge electrode is adapted to be supplied with a DC voltage of sufficient magnitude to create a corona current flow from the electrode to the surface of a photoreceptor in spaced relationship therefrom. The geometry of a typical corona discharge device admits of various configurations as disclosed in U.S. Pat. No. 2,879,295 which issued to L. E. Walkup and assigned to Xerox Corporation.

Although the corona discharge device is advantageously utilized to deposit a uniform layer of electrostatic charge on the surface of a photoreceptor, various other applications thereof have been adopted. Typical of these applications are electrostatic transfer of a developed image to an image receiving member, removal of background toner particles from a developed electrostatic latent image and pre-cleaning of a photoreceptor by neutralizing the charge on toner particles adhering to the surface of the photoreceptor after transfer of the developed image to an image receiving member. An attendant disadvantage of corona discharge devices developed by the prior art for use in electrophotographic reproducing devices is the accumulation of dust particles and toner particles on and about the interior of the corona discharge device to such an extent that the corona current generated thereby substantially decreases as the density of particle accumulation increases. Accordingly, self-cleaning corona discharge devices have been developed which employ corona winds inherently generated by a corona discharge device as a means to clean the corona discharge electrode and the interior walls of the surrounding shield. Detailed descriptions of such devices may be found in U.S. Pat. No. 3,324,291 which issued to F. W. Hudson on June 6, 1967 and assigned to Xerox Corporation and in U.S. Pat. No. 3,471,695 which issued to F. W. Hudson et al on Oct. 7, 1969 and assigned to Xerox Corporation.

An alternative embodiment of a self-cleaning corona discharge device comprises an AC corona discharge device wherein the corona discharge electrode thereof is supplied with a corona generating AC voltage. As is understood by those of ordinary skill in the art, the creation of a corona current is predominantly determined by the potential difference between the corona discharge electrode and the partially surrounding shield. Accordingly, if the shield is comprised of a metal shield supplied with a reference potential, such as ground potential, a positive corona current will be generated when the difference between the AC voltage applied to the corona discharge electrode and the reference potential supplied to the metal shield exceeds the positive corona threshold voltage; and a negative corona current will be generated when the difference between the AC voltage applied to the corona discharge electrode and the reference potential supplied to the metal shield exceeds the negative corona threshold. In theory then, a maximum AC corona current is generated for the embodiment of an AC corona discharge device including a grounded metal shield. Unfortunately, the grounded shield AC corotron suffers from the disadvantage that toner or dirt particles which accumulate on the inner walls of the metal shield and are not effectively removed therefrom produce deleterious effects. More specifically, these particles are comprised of dielectric material which store the charged ions communicated thereto from the corona discharge electrode during the discharge. As charge build-up on these particles occurs, a voltage is induced on the contaminated inner wall of the surrounding shield resulting in a non-uniform potential difference between the corona discharge electrode and the shield. Hence, the AC corona current is subject to variations due to the discontinuities in the aforementioned potential difference.

A suggested improvement over the grounded metal shield AC corona discharge device is comprised of an AC corona discharge device having an insulating or dielectric shield constructed of a plastic material. The accumulation of dielectric particles on the inner surface of the dielectric shield has no appreciable effect upon the AC corona current. This advantageous characteristic is however, achieved at the loss of magnitude of the AC corona current.

OBJECTS OF THE INVENTION

It is an object of the present invention to provide a cleaning assembly for a corona discharge device.

Another object of this invention is to provide an apparatus for cleaning a corona discharge device which may be affected during an imaging mode of an electrostatographic machine.

SUMMARY OF THE INVENTION

These and other objects of the invention are obtained by providing a cleaning assembly including a wiper formed of a non-abrasive material positioned about a corona wire and within a conductive shield. The wiper is disposed within support members affixed to arm members guided for movement within the conductive shield. The other ends of the arm members are affixed to a handle. Movement of the handle laterally causes the wiper to traverse the corona wire thereby cleaning the corona wire and as well as the inner surface of the conductive shield.

DESCRIPTION OF THE DRAWINGS

A better understanding of the present invention as well as other objects and further features thereof will become apparent upon consideration of the following detailed disclosure thereof, especially when taken with the accompanying drawings, wherein like numerals designate like parts throughout and wherein.

DETAILED DESCRIPTION OF THE INVENTION

Figure 1:
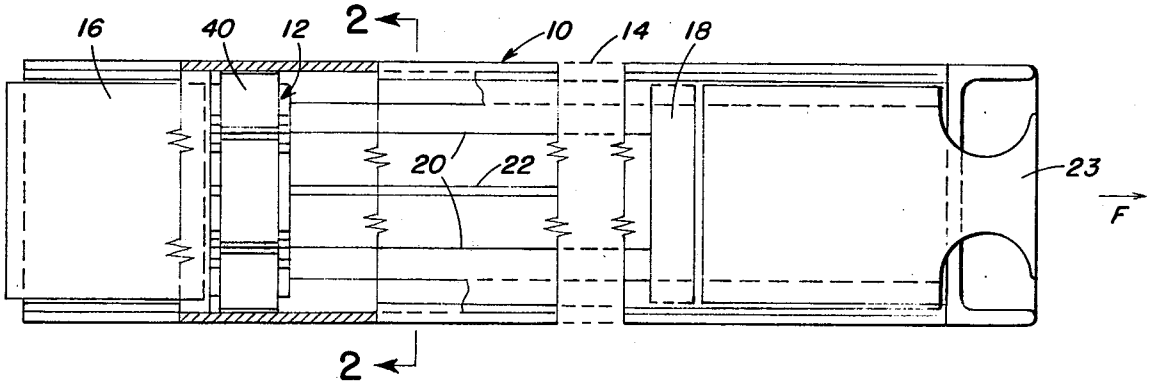
FIG. 1 is a bottom view, partially in section, of a corona discharge device illustrating the cleaning assembly of the present invention.
Figure 2:
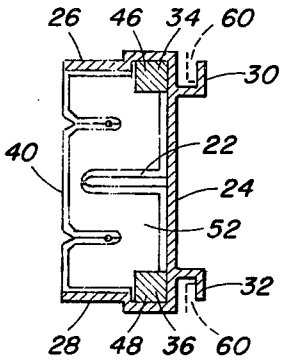
FIG. 2 is a cross-sectional view thereof taken along the lines 2—2 of FIG. 1.

Referring now to FIGS. 1 and 2, there is illustrated a corona discharge device, generally indicated as 10, and a corona wire cleaning assembly, generally indicated as 12. The corona discharge device 10 is comprised of a U-shaped shield 14 of conductive material, insulating end plates 16 and 18, corona discharge electrodes 20, a directional baffle 22, and an end block 23. The shield 14 is disposed in partially surrounding relationship with respect to the corona discharge electrodes 20, with the directional baffle 22 extending between such electrodes 20. The shield 14 is formed of a top wall 24, stepped side walls 26 and 28, and support means 30 and 32, and may be unitary construction. The stepped side walls 26 and 28 of the shield 14 form guide channels 34 and 36, respectively, with the top wall 24 of the shield, as more fully hereinafter described.

The corona discharge electrodes 20 are mounted within the insulating end plates 16 and 18 disposed at opposite ends of the shield 14. Suitable connecting means (not shown), such as described in co-pending application D/3050, entitled AC Corotron, are provided on the end plates 16 and 18 for connecting the corona discharge electrodes 20 to a suitable source of corona generating voltage (not shown).

Figure 3:
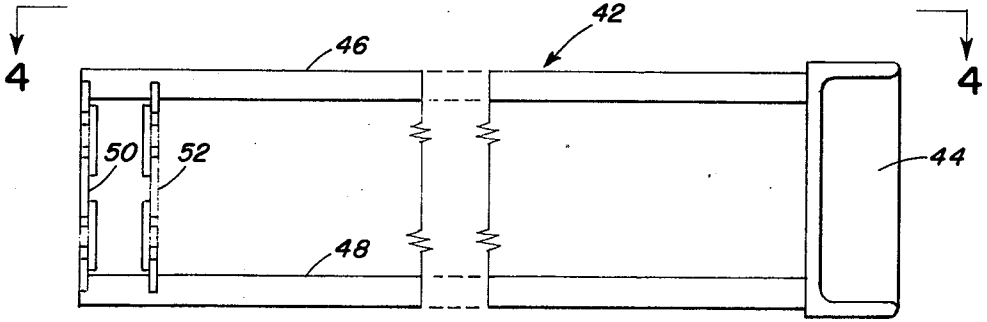
FIG. 3 is a bottom view of the wiper support assembly.
Figure 4:
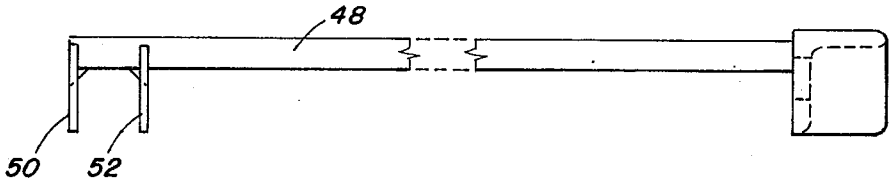
FIG. 4 is a side view of the wiper support assembly of FIG. 3.

The cleaning assembly 12 is comprised of a wiper 40 formed of a non-abrasive material, such as an expanded polyester, and a wiper support assembly, generally indicated as 42. Referring to FIGS. 3 and 4, the wiper support assembly 42 is comprised of a handle 44, square-shaped rod members 46 and 48, and wiper support plates 50 and 52. The rod members 46 and 48 are disposed parallel to each other and are affixed at one end to the handle 44, and are affixed at the other end to the support plates 50 and 52. The support plates 50 and 52 are spaced apart and are provided with V-shaped securing arm member 54 to clamp the wiper 40 therebetween. It is found desirable to utilize a wiper having a thickness greater than the distance between the wiper support plates thereby essentially locking the wiper therebetween, as compared to a wiper of reduced thickness thereby permitting the wiper "to float" between the support plates in operation.

Figure 5:
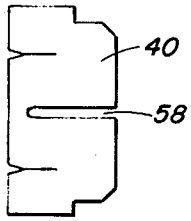
FIG. 5 is a plan view of the wiper.

FIG. 5 illustrates a plan view of the wiper 40, one surface of which is provided with slits to receive the corona discharge electrodes 20, with the remaining surface thereof having a configuration generally that of the inner surface of the shield 14. The wiper 40 is provided with an elongated slot 58 dimensioned to receive the directional baffle 22 to permit thereby positioning of the wiper 40 within the shield 14.

The corona discharge device 10 is received by supporting arm members 60 of an electrostatographic machine (not shown). The end block 23 is affixed to the top wall 24 of the shield 14 to facilitate the removal of the corona discharge device 10 from the machine. Upon assembly of the corona discharge device 10 including the cleaning assembly 12, the rod members 46 and 48 are received by the guide channels 34 and 36. To clean the corona discharge electrodes 20 as well as the inner surface of the shield 14, the operator causes the cleaning assembly 12 to move co-axially within the shield 14 by exerting an outward force on the handle 23, as illustrated by the arrow in FIG. 1. Such relative movement of the cleaning assembly 12 within the shield 14 causes the wiper 40 to traverse the corona discharge electrodes 20 and the inner surface of the shield 14 thereby removing solids materials, e.g., dust and toner particles, from the contacted surfaces. A force in the opposite direction causes the cleaning assembly to be returned to its initial position.

While the present invention has been described with reference to a corona discharge device having two discharge electrodes separated by a directional baffle, it is understood that the present invention may be utilized in a corona discharge device having one or more than two corona discharge electrodes. Additionally, while normal operation of the cleaning assembly is described, the cleaning assembly may be caused to move within the corona discharge device by a geared assembly driven by a suitable motor means and remotely operated.

Other modifications of the present invention will occur to those skilled in the art upon a reading of the present disclosure which modifications are intended to be included within the scope of this invention.

What is claimed is:

1. A corona discharge device having at least one corona discharge electrode, a conductive shield partially surrounding the discharge electrode, the shield having a plurality of guide channels formed therein, resilient wiper means positioned within the shield and in contact with both the discharge electrode and the shield, means for moving the wiper means along the discharge electrode and the shield so as to clean both, the moving means including a plurality of rods and at least two support plates affixed to the rods in a spaced relationship for supporting the wiper means between the plates, the rods being disposed within the channels, the wiper means being disposed between the plates, and the distance between the plates being less than the thickness of the wiper means so as to compress the wiper means between the plates.

* * * * *